US012053659B2

(12) United States Patent
Kelly et al.

(10) Patent No.: US 12,053,659 B2
(45) Date of Patent: Aug. 6, 2024

(54) RESISTANCE DEVICE

(71) Applicant: FITPAC Pty Ltd., Elwood (AU)

(72) Inventors: Myles Kelly, Elwood (AU); Warwick Brown, North Melbourne (AU); Libby Christmas, North Melbourne (AU); Marcus Krigsman, North Melbourne (AU); Robert Cuzner, North Melbourne (AU); Mark Economos, Elwood (AU); Craig Burton, North Melbourne (AU)

(73) Assignee: FITPAC Pty Ltd., Elwood (AU)

( * ) Notice: Subject to any disclaimer, the term of this patent is extended or adjusted under 35 U.S.C. 154(b) by 0 days.

(21) Appl. No.: 18/323,918

(22) Filed: May 25, 2023

(65) Prior Publication Data

US 2023/0293929 A1 Sep. 21, 2023

Related U.S. Application Data

(63) Continuation of application No. 17/048,994, filed as application No. PCT/AU2018/050352 on Apr. 19, 2018, now Pat. No. 11,833,382.

(51) Int. Cl.
*A63B 21/00* (2006.01)
*A63B 21/008* (2006.01)

(52) U.S. Cl.
CPC .. *A63B 21/00065* (2013.01); *A63B 21/00185* (2013.01); *A63B 21/0085* (2013.01); *A63B 21/4035* (2015.10); *A63B 21/4043* (2015.10)

(58) Field of Classification Search
CPC ..... A63B 21/00058; A63B 21/00061; A63B 21/00065; A63B 21/00069;
(Continued)

(56) References Cited

U.S. PATENT DOCUMENTS 4,402,504 A 9/1983 Christian
5,618,249 A 4/1997 Marshall
(Continued)

FOREIGN PATENT DOCUMENTS

CN 204619291 U 9/2015
WO WO-2004062741 A1 7/2004
WO WO-2018195587 A1 11/2018

OTHER PUBLICATIONS

"U.S. Appl. No. 17/048,994, Notice of Allowance mailed Jul. 25, 2023", 9 pages.
(Continued)

*Primary Examiner* — Zachary T Moore
(74) *Attorney, Agent, or Firm* — Schwegman Lundberg & Woessner, P.A.

(57) ABSTRACT

A resistance device for providing resistance. The device includes a flexible pulling element, a resilient arrangement and a transmission. The resilient arrangement has a first portion and a second portion. The second portion is resiliently movable relative to the first portion. The transmission connects the flexible pulling element to the resilient arrangement such that pulling upon the flexible pulling element moves the second portion relative to the first portion, and upon release of the flexible pulling element the resilient arrangement retracts the flexible pulling element. The transmission is a reduction arrangement such that pulling the flexible pulling element a distance moves the second portion, relative to the first portion, no more than a proportion of the distance. The proportion is no more than half.

20 Claims, 10 Drawing Sheets

(58) Field of Classification Search
CPC ..... A63B 21/00072; A63B 21/008; A63B 21/0083; A63B 21/0084; A63B 21/0085; A63B 21/0087; A63B 21/0088; A63B 21/00185; A63B 21/4035; A63B 21/4043; A63B 21/0442; A63B 21/154; A63B 21/4005; A63B 21/4007; A63B 21/4011; A63B 23/035; A63B 23/03508; A63B 23/03516; A63B 23/03525; A63B 23/03533; A63B 23/0355; A63B 23/03558; A63B 23/03575; A63B 23/03583; A63B 23/03591
See application file for complete search history.

(56) References Cited

U.S. PATENT DOCUMENTS

| | | | | |
|---|---|---|---|---|
| 6,015,371 | A | 1/2000 | Davitt | |
| 6,142,919 | A | 11/2000 | Jorgensen | |
| 6,669,609 | B2 | 12/2003 | Gerschefske et al. | |
| 7,250,022 | B2 | 7/2007 | Dalebout et al. | |
| 7,854,694 | B1 | 12/2010 | Frunzi | |
| 8,968,167 | B1 * | 3/2015 | Abelbeck ..... | A63B 21/0557 482/130 |
| 11,123,596 | B2 | 9/2021 | Robinson | |
| 2003/0069112 | A1 | 4/2003 | Williams | |
| 2008/0318740 | A1 * | 12/2008 | Ross ..... | A63B 21/063 482/92 |
| 2009/0023561 | A1 * | 1/2009 | Ross ..... | A63B 21/055 482/92 |
| 2010/0130338 | A1 * | 5/2010 | Wehrell ..... | A63B 21/4007 473/215 |
| 2011/0183819 | A1 | 7/2011 | Pharoe | |
| 2013/0324366 | A1 | 12/2013 | Pride | |
| 2014/0148316 | A1 | 5/2014 | Tsuchio et al. | |
| 2015/0126347 | A1 * | 5/2015 | Kaye ..... | A63B 23/03541 482/129 |
| 2021/0268326 | A1 | 9/2021 | Kelly et al. | |

OTHER PUBLICATIONS

"U.S. Appl. No. 17/048,994, Preliminary Amendment Filed Oct. 19, 2020", 8 pgs.
"U.S. Appl. No. 17/048,994, Supplemental Preliminary Amendment Filed Dec. 7, 2020", 7 pgs.
"U.S. Appl. No. 17/048,994, Final Office Action mailed Jul. 21, 2022", 25 pgs.
"U.S. Appl. No. 17/048,994, Non Final Office Action mailed Feb. 9, 2023", 24 pgs.
"U.S. Appl. No. 17/048,994, Non Final Office Action mailed Dec. 8, 2021", 23 pgs.
"U.S. Appl. No. 17/048,994, Response filed Jan. 23, 2023 to Final Office Action mailed Jul. 21, 2022", 13 pgs.
"U.S. Appl. No. 17/048,994, Response filed Apr. 8, 2022 to Non Final Office Action mailed Dec. 8, 2021", 19 pgs.
"U.S. Appl. No. 17/048,994, Response filed May 23, 2023 to Non Final Office Action mailed Feb. 9, 2023", 14 pgs.
"International Application No. PCT/AU2018/050352, International Search Report and Written Opinion mailed May 15, 2018", (May 15, 2018), 9 pgs.

* cited by examiner

RESISTANCE DEVICE

PRIORITY CLAIM TO RELATED APPLICATIONS

This application is a continuation of U.S. application Ser. No. 17/048,994, filed on 19 Oct. 2020, which is a U.S. national stage filing under 35 U.S.C. § 371 from International Application No. PCT/AU2018/050352, filed on 19 Apr. 2018, and published as WO2018/195587 on 1 Nov. 2018, the benefit of priority of which is claimed herein, and which application and publication are hereby incorporated herein by reference in its entirety.

FIELD OF THE INVENTION

The invention relates to resistance devices. A preferred form of the device is an exercise device although the invention may well be applied in other contexts.

BACKGROUND TO THE INVENTION

It is commonplace to use resistance devices to provide a resistance against which exercises can be performed. Resistance bands are popular. A resistance band is a simple length of elastic material often having a respective handle at each of its ends. By way of example, a user can perform a bicep curl by gripping one handle in each hand and stepping on a middle portion of the band. The portions of the band between the user's hands and the user's foot stretch to provide the resistance against which the user's biceps works. It is possible to buy resistance bands of varying strength and some arrangements allow for multiple lengths of elastic material to be simultaneously attached to the handles so that the resistance can be varied by selecting the number of bands to be stretched.

Resistance bands are typically simple and portable in contrast to weights which are too heavy to carry around or other exercise equipment which may be too bulky. On the other hand, the present inventors have recognised some shortcomings of such resistance bands.

As the bands are elastically stretched to provide the necessary resistance, the amount of resistance is typically highly variable depending on the extent to which the band is stretched. Moreover, the amount of force varies throughout the stroke of the exercise. By way of example, the resistance experienced by a user performing a bicep curl will vary depending on the height of the user and will also vary through the stroke of the curl.

The present inventors have also recognised that resistance bands can violently release the potential energy they store and that this can be problematic. During the course of an exercise, the band can pull back violently which is less than ideal in the context of performing exercises.

When performing exercises, particularly in the context of rehabilitation exercises, slow controlled movements are very much preferred to avoid injury and optimise muscle development. The release of energy is also problematic if the band is inadvertently released, e.g. if the user's foot slips off the middle of the band during the bicep curl the user may well be struck in the face by the rapidly rising middle portion of the band.

Resistance bands are typically perishable. They tend to split/fray/weaken over time, particularly when exposed to sunlight.

The inventors have recognised that their invention has application well beyond the context of exercising. As such, the invention aims to provide improvements in and for resistance devices, or at least to provide an alternative for those concerned with resistance devices.

SUMMARY

One aspect of the invention provides a resistance device, for providing resistance, including

- a flexible pulling element,
- a resilient arrangement; and
- a transmission;
- the resilient arrangement having a first portion and a second portion;
- the second portion being resiliently moveable relative to the first portion;
- the transmission connecting the flexible pulling element to the resilient arrangement such that
  - pulling upon the flexible pulling element moves the second portion relative to the first portion, and
  - upon release of the flexible pulling element the resilient arrangement retracts the flexible pulling element;
- the transmission being a reduction arrangement such that pulling the flexible pulling element a distance moves the second portion, relative to the first portion, not more than a proportion of the distance;
- the proportion being not more than half.

Preferably, the proportion is not more than one fifth, e.g. it may be about one ninth. Even higher reduction ratios, e.g. wherein the proportion is not more than about one twentieth, may be advantageous, e.g. in combination with stronger struts a more compact unit may be produced.

The transmission may include an arrangement of pulleys.

Preferably the device includes a feature by which the resilient arrangement is connectable to an anchor point. The feature may be at least one of a hook and a loop. The flexible pulling element may have a loop to which a handle is attachable. The flexible pulling element may have a or the handle. The flexible pulling element may have an ankle strap. The resilient arrangement preferably has a stroke length of not more than 150 mm. It may include one or more gas struts. Preferably it includes at least two resilient elements;

- at least one of the resilient elements is a selectable element; and
- the device includes a selector mechanism by which at least one of the selectable element(s) is selectively engageable to vary the resistance.

Another aspect of the invention provides a resistance device, for providing resistance, including

- a resilient arrangement; and
- a selector mechanism;
- the resilient arrangement having a first portion, a second portion and at least two resilient elements;
- the second portion being resiliently moveable relative to the first portion; one or more of the resilient elements being one or more first selectable elements;
- the selector mechanism being a mechanism by which at least one of the
- one or more first selectable elements is selectively engageable to vary the resistance.

The selector mechanism may include a first selector member carried by the second portion and movable

- from at least one engaging position in which the first selector member is positioned to engage a portion of the at least one of the one or more first selectable elements;

to a disengaging position in which the first selector member is positioned to enable the second portion to move along the portion of the at least one of the one or more first selectable elements.

The device may include at least three of the resilient elements.

Preferably the selector mechanism enables each of one, two and three of the resilient elements to be selected.

The device may include a user-manipulable portion manipulable by a user to move the first selector member to vary the resistance. The selector member is preferably arranged to move away from the user-manipulable portion when the second portion moves relative to the first portion. The second portion preferably includes a detent-mechanism to restrain the selector member.

Preferably a detent-mechanism acts between the user-manipulable portion and a fixed portion of the device to cause the user-manipulable portion to click into positions corresponding to the disengaging position and the engaging position(s).

The device may include a locking mechanism for locking the user-manipulable portion against inadvertent movement when the selector member is so moved away. The locking mechanism may include a lock member movable from a locking position in which the member engages each of a or the fixed portion of the device and the user-manipulable portion;

to an adjusting position in which locking member is movable relative to the fixed portion and engages each of the user-manipulable portion and the selector member.

The device may include a bias-element by which the locking member is resiliently biased toward the locking position. The locking member may be arranged to be driven against the bias-element and away from the locking position by the resilient arrangement.

Optionally, one or more of the resilient elements are one or more second selectable elements. The selector mechanism may be a mechanism by which at least one of the one or more second selectable elements is selectively engageable to vary the resistance.

The selector mechanism may include a second selector member carried by the second portion and movable from at least one engaging position in which the second selector member is positioned to engage a portion of the at least one of the one or more second selectable elements;

to a disengaging position in which the second selector member is positioned to enable the second portion to move along the portion of the at least one of the one or more second selectable elements.

The selector mechanism may be configured to coordinate the first selector member and the second selector member. The user-manipulable portion may be manipulable by a user to move the second selector member to vary the resistance. The selector mechanism may include an intermittent motion mechanism for transmitting drive from the user-manipulable portion to second selector member. The intermittent motion mechanism preferably includes a pinion gear arranged to cooperate with a discontinuous rack. Most preferably the intermittent motion mechanism includes at least one blocking portion for positively stopping the pinion gear during a lost-motion phase of operation.

Preferably the coordination is so that sequential movements of the user-manipulable portion causes the first selector member to move to positions providing an occurrence, and one or more repetitions, of a repeating sequence of resistances associated with the first selector member; and the second selector member to move with each of the repetitions;

to provide a user with sequential resistances respectively corresponding to the sequential movements.

The resilient elements may be gas struts.

Another aspect of the invention provides a wearable exercise device including at least one resistance device. The wearable exercise device may include shoulder straps.

Another aspect of the invention provides a method of exercising including utilising a resistance device to resist movement. The method may include performing an uninterrupted set of repetitions of an exercise. The exercise may be one of a squat, a bicep curl, a lunge, a tricep extension and a chest press.

DETAILED DESCRIPTION OF THE DRAWINGS

Figure 1:
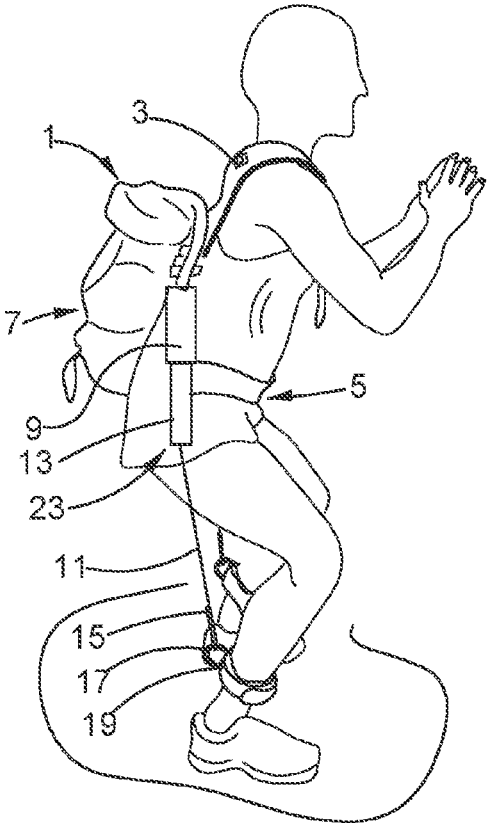
FIG. 1 is a side view of a user performing a squat.

Turning to FIG. 1, a wearable exercise device 1 takes the form of a backpack incorporating shoulder straps 3 by which the device 1 is wearable in the manner of a backpack. This example of the device also includes a waist strap 5 and a cargo carrying space 7.

A resistance device 9 is connected to an anchor point fixed relative to the user's torso. The anchor point of the device 1 is a simple loop. Clips (e.g. moulded plastic clips), touch fastening fabric (such as Velcro™ brand hood and loop fabric) and/or straps are other options. In this example the anchor point is fixed relative to the shoulder straps 3 and the device 1 is configured to position an outlet 23 of the device 9 at hip height. A flexible pulling element in the form of a cable 11 extends from the bottom of the resistance device's main body 13. Another example of the device 9 incorporates a flexible pulling element in the form of a rope.

The cable 11 is preferably a Bowden cable, most preferably of low-friction, high-spec steel and with a nylon coating or other suitable lubrication. In this example, the cable 11 has the following specifications:

Strand configuration=1×19

Diameter=1.6 mm

Material=316 SS

Minimum breaking strain=1.62 kN

At an end of the cable 11 external to the body 13, the cable 11 terminates in a loop 15. The loop is formed by a suitable crimp. An attachment element in the form of carabiner 17 attaches the loop 15 to an ankle strap 19. The attachment element is preferably a non-locking carabiner (i.e. has no threaded collar, etc) or snap-style clip hook for convenience.

The device 9 is configured to enable the cable 11 to be withdrawn from the body 13 whilst providing a controlled resistance and to retract the cable 11 into the body 13 when the pulling force is reduced (e.g. reduced to zero).

As such, the device 9 pulls the user's body, via the shoulder straps 3 and waist strap 5, down towards the user's ankle. This pulling down provides resistance against the action of rising up from the squat. This resistance is akin to the resistance that would be experienced if the user had a barbell across the back of their shoulders.

In this example of the device 1, there is a respective one of the resistance devices 9 for each of the user's two legs.

Figure 2:
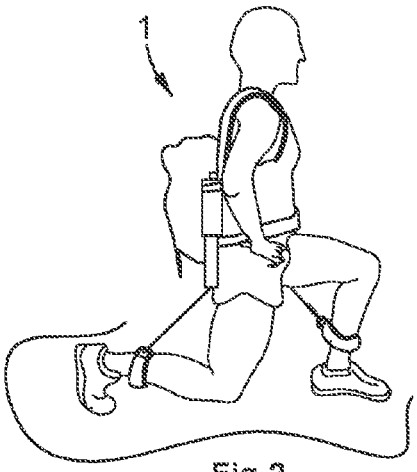
FIG. 2 is a side view of the user performing a lunge.

As suggested in FIG. 2, with the device 1 configured as in FIG. 1, lunges can be performed against the resistance of the device 9.

Figure 3:
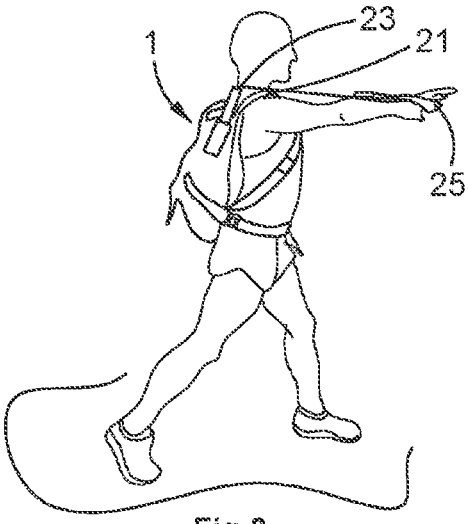
FIG. 3 is a side view of the user performing a chest press.
Figure 4:
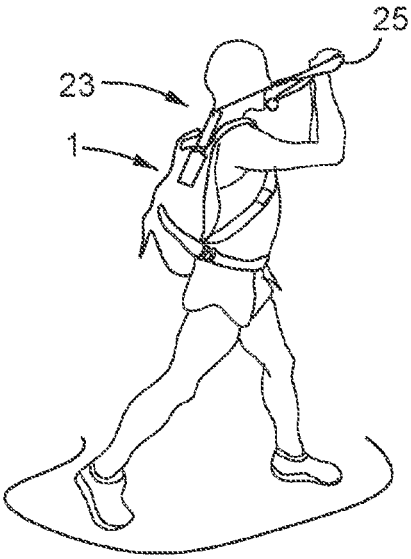
FIG. 4 is a side view of the user performing a tricep extension.

FIGS. 3 and 4 illustrate the device 1 reconfigured to perform certain upper body exercises. Relative to the configuration of FIGS. 1 and 2, the main body 13 has been inverted and attached to a lower anchor point fixed relative to the user's torso. A suitable loop 21 of the device 1 holds the body 13 upright so that its outlet 23, at the end of the body 13 remote from the anchor point, sits at or no more than 50 mm above the user's shoulder height. Other mechanisms for so orienting the body 13 are possible.

With the outlet 23 positioned above the shoulders, the cable 11 is positioned to pass over the user to resist movement of the hands away from the user's body. In this configuration the ankle straps 19 are replaced by handles 25. For other exercises, wrist straps may be attached to the end of the cable 11. Other straps may be used. The cable might be attached to shoe clips or shoe-covering casings, etc.

Figure 5:
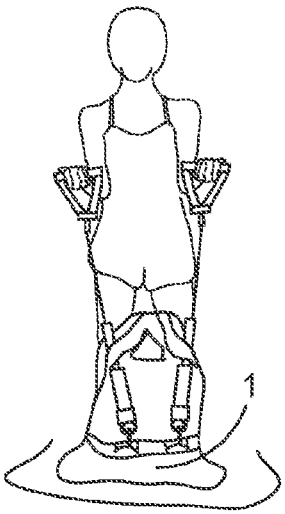
FIG. 5 is a front view of the user performing a bicep curl.
Figure 6:
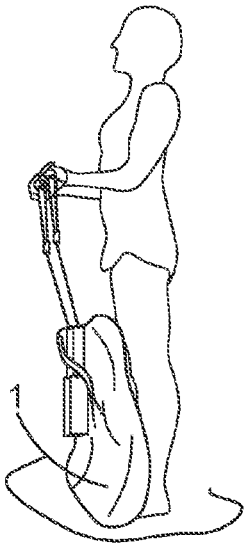
FIG. 6 is a side view of the user performing a bicep curl.
Figure 7:
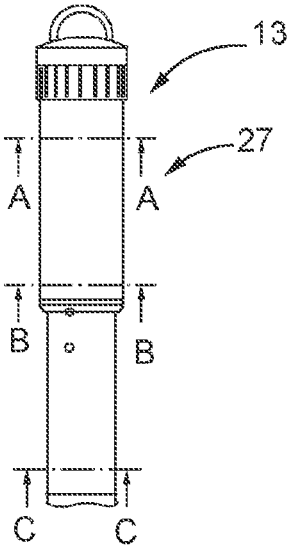
FIG. 7 is a front view of a resistance device.
Figure 8:
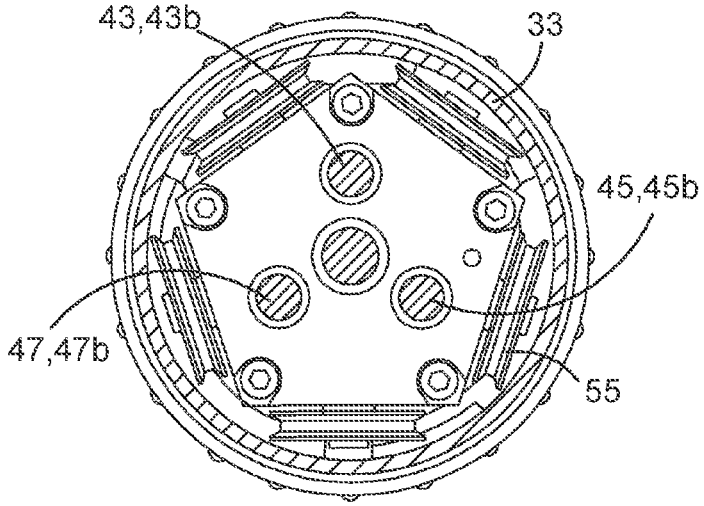
FIG. 8 is a cross-section view corresponding to the line A-A in FIG. 7.
Figure 9:
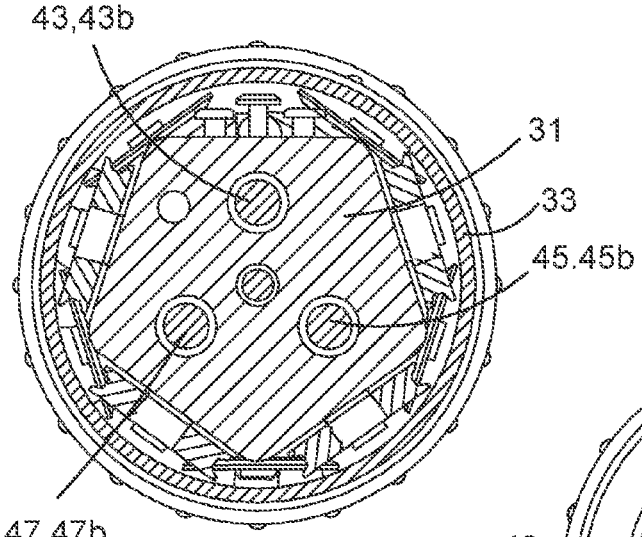
FIG. 9 is a cross-section view corresponding to the line B-B in FIG. 7.
Figure 10:
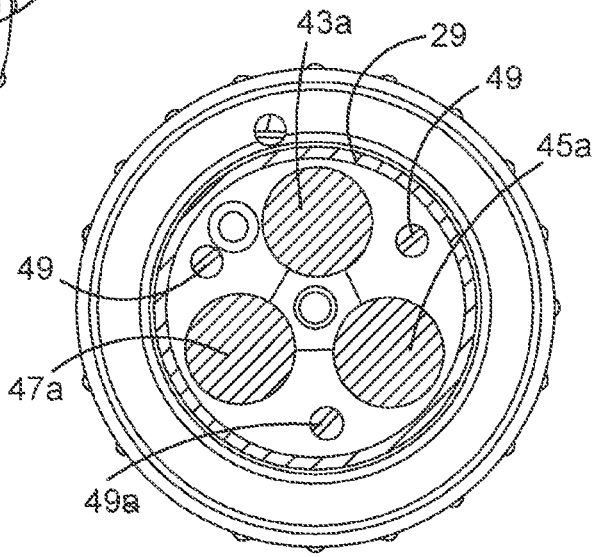
FIG. 10 is a cross-section view corresponding to the line C-C in FIG. 7.
Figure 11:
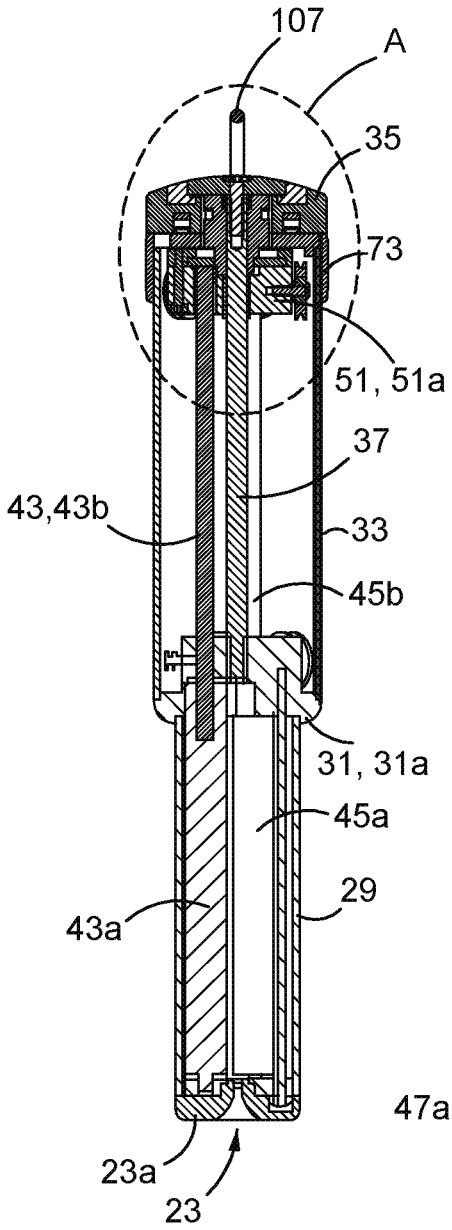
FIG. 11 is a vertical cross-section view of the resistance device of FIG. 7.
Figure 12:
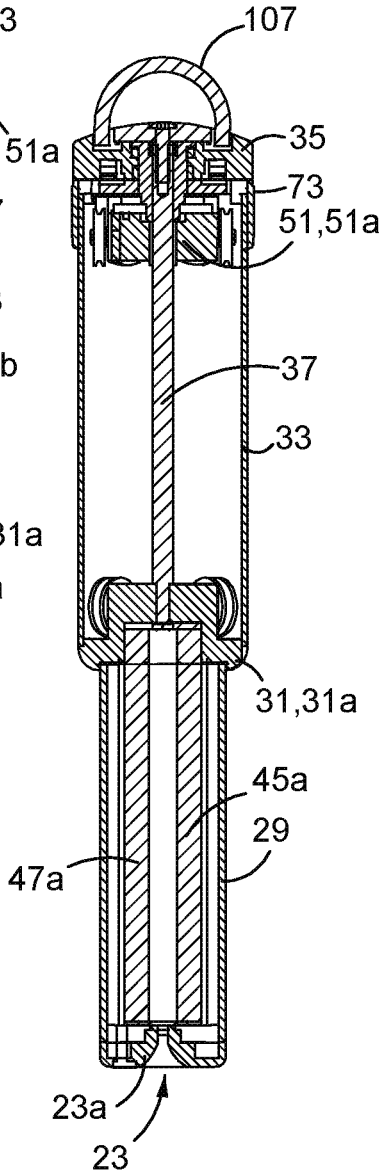
FIG. 12 is another vertical cross-section view of the device of FIG. 7.

In FIGS. 5 and 6 the device 1 has been removed from the user's shoulders and placed on the ground. By standing on a suitable foot-engaging portion of the device 1, the bodies 13 are effectively anchored to the ground to enable their cables to be resiliently pulled out as the user's hands are moved upwardly.

FIGS. 7 to 20 illustrate the body 13 of the device 9 and its internal components. The cable 11 is omitted from these views for clarity.

The device 9 includes a rigid outer 27 made up of four principal components: outlet member 23*a* (defining the outlet 23), lower tube 29, connector body 31, upper tube 33 and upper end cap 35. A first portion 31*a* comprises the connector body 31.

For the avoidance of doubt, 'upper' and 'lower' and similar terms are used herein with reference to the illustrated orientation of the device as an aid to the reader only. The invention is not limited to devices capable of operation in the illustrated orientation.

A guide 37 runs coaxially within the upper tube 33. In this example the guide 37 also functions as a tie-rod mutually tying the bodies 31, 35. The lower end of the guide is threadingly engaged with the body 31 whilst a threaded fastener 39 fastens a retaining member 41 to the top end of the guide 37. The retaining member overlies part of the top cap 35.

The outer 27 is a rigid casing internally carries a trio of gas struts 43, 45, 47. Each of the struts includes a strut body 43*a*, 45*a*, 47*a* and a rod 43*b*, 45*b*, 47*b*. A trio of tie-rods 49 tie the outlet member 23*a* to the connector body 31.

Housed within the upper tube 33 is a moveable member 51 mounted to move along the guide 37. The member 51 carries a selector plate 53 which, in the position illustrated in FIG. 14, overlies a top end of the rod 43*b* to select the gas strut 43. A second portion 51*a* comprises the body 51.

The body 51 carries five pulleys 55. In this example the pulleys are equally spaced about the periphery of the member: in cross-section transverse to the gas struts the body is pentagonal and each of the pulleys 55 is positioned on a respective edge of the pentagon.

The member 31 includes a similar five-sided portion is offset from the five-sided portion of the member 51 by one tenth of a rotation.

Each of four of the five sides of the connector body 31 carries a respective pulley 55. The fifth side of that body carries an anchor point 57.

The cable 11 is routed into the body 13 via the inlet 23 whereat it enters a suitable flexible sleeve by which the cable is routed through a suitable penetration in an upper portion of the lower tube and into the upper tube 33 via a suitable penetration in a lower portion of the wall of the lower tube 33. This sleeve and penetrations are not shown in the Figures.

From the penetration in the lower portion of the tube 33, the cable is laced alternately about upper and lower ones of the pulleys 55 and anchored to the anchor point 57.

The gas struts 43, 45, 47 and portions 31, 51 together form a resilient arrangement. The pulleys 55 and the routing of the cable thereabouts form a transmission by which the cable is connected to the resilient arrangement such that pulling upon the cable causes the portion 51 to move towards the portion 31.

The serpentine routing of the cable about the pulleys 55 forms a reduction arrangement akin to a block and tackle such that withdrawing a length of the cable 11 causes the portion 51 to move a distance that is less than the length. In this example, the reduction ratio is 9 to 1 whereby withdrawing one metre of cable moves the portion 51 about 11 cm towards the portion 31.

This reduction arrangement allows for a length of cable 11 to be withdrawn from the body 13 that is useful for performing exercises whilst the body 13 remains conveniently compact.

In this example, the resilient arrangement incorporates gas struts 43, 45, 47 although other variants are possible. By way of example, in a rudimentary form of the device the gas struts may be eliminated and a simple compression spring positioned to act between the portions 31, 51.

Gas struts are preferred because proprietary gas struts are economically available and provide resistance that is relatively uniform along their stroke length relative to other resistance devices such as typical springs and resistance bands, etc. Each of the struts 43, 45, 47 has the following specifications:

15 mm diameter cylinder
6 mm diameter piston
Cylinder length=145 mm
Strut max stroke=120.5 mm
Strut free length=300 mm
Strut force (max lifting force)=400 N Whilst gas struts provide force that (relative to other resilient arrangements such as typical springs) is uniform, there is some variation in force along the stroke of the gas strut and between the extension and compression phases of the strut's operation. The 'strut force (max lifting force)' corresponds to the force during the extension phase measured 5 mm before the complete extension of the piston. This is the typical operating point at which compression struts are characterised. It is almost the lowest force produced by the strut. Typically the lowest force is at the very end of the extension phase.

Testing confirms that:

- each of the struts 43, 45, 47, through the reduction arrangement, provides the user with about 50 kilograms of resistance when the cable is withdrawn from the body 13 at a rate of about 0.5 m/sec, and
- when a user provides a force of about 35 kilograms, the cable is retracted (and the strut extended) at about the same rate.

The about 0.5 m/sec rate of cable movement corresponds to a desirable rate for exercising.

The outlet member 23 defines a lead-in, in the form of a bell mouth, having a suitable low friction and abrasion resistant exterior over which the cable 11 can be pulled at varying angles relative to the body 13. A relief gland might be used in place of the bell mouth.

In addition to providing relatively uniform and controlled resistance, typical economically available gas struts also provide a slight degree of dampening which goes some way to addressing the problem of the violent release of energy that can be experienced with resistance bands. The reduction arrangement also goes some way to addressing these problems in that the friction inherent in the mechanism also goes some way to mitigating the potentially violent retraction of the cable 11 if it is inadvertently released from an extended state.

The illustrated device incorporates a selector mechanism 59 by which the resistance to the withdrawal of the cable 11 can be varied. The mechanism 59 incorporates the selector plate 53 and an annular retainer 61. The retainer 61 overlies an outer periphery of the selector plate 59 and is fastened to the body 51 to retain the selector plate 53. The retainer plate 61 has a stepped interior shaped to allow the selector plate 53 to rotate about the long axis of the body 13 whilst the retainer plate 61 is clamped against the body 51.

The selector plate 53 includes:

a central opening 63 equipped with a trio of keyways 63*a*,
a circular opening 65,
a kidney slot 67 and
(on its underside) a trio of dimples 69.

Figure 16:
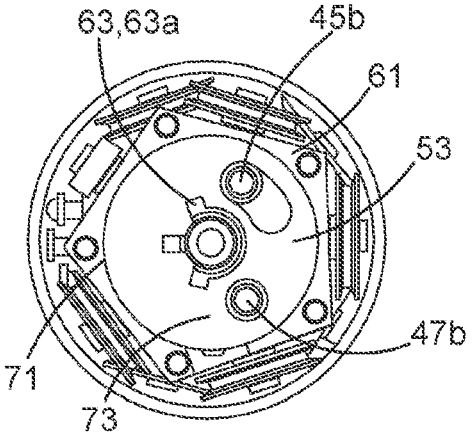
FIG. 16 is a top view of selected components of the resistance device.

The body 51 carries a spring-loaded detent member co-operable with the dimples 69 to define three discrete angular positions of the selector plate 53. FIG. 16 illustrates one of those angular positions in which the opening 65, 67 sit in register with the rods 45*b*, 47*b* of the gas struts 45, 47, whilst a blocking portion 71 of the selector plate 53 overlies the rod 43*b* of the gas strut 43.

When the selector plate 53 is in the position of FIG. 16 and the cable 11 pulled upon to move the portion 51 downwardly, the blocking portion 71 acts on the strut 43 whereby the strut 43 resists the withdrawal of the cable. At the same time, the rods 45*b*, 47*b* simply pass through the openings 65, 67 whereby the struts 45, 47 do not resist the withdrawal of the cable. The selector plate 53 simply moves along the rods 45*b*, 47*b* of the struts 45, 47. As such, as the wording is used herein, in this configuration the struts 45, 47 are deselected.

In the configuration of FIG. 16, the rod 45*b* sits in register with one end of the kidney slot 47. Rotating the plate 53 to another of the defined orientations (corresponding to another of the dimples 69) moves the other end of the kidney slot into register with the rod end 45*b* whilst a blocking portion 73 of the plate 53 moves to overlie the rod 47*b*. Through this motion of the blocking portion 73, the gas strut 47 is selected. As such, the struts 43, 47 both resist the withdrawal of the cable whilst the rod 45*b* remains in register with the kidney slot 67 so the strut 45 remains deselected.

Rotating the selector plate 53 to a third of the predefined orientations serves to block all three of the rods and thereby engage all three of the gas struts. The gas strut 43 remains engaged with the selector plate 53 for all three angular positions of the selector plate 53 whereas the struts 45, 47 are selected depending on the position of the plate 53. As such, as the wording is used herein, the struts 45, 47 are selectable elements.

As above, when the cable is pulled out, each gas strut produces a resistance of about 50 kilograms which, via the reduction arrangement, the user experiences as a resistance of about 5 kilograms. As such, the three selectable positions of the selector plate 53 give the user the choice of 5, 10 or 15 kilograms of resistance. The device 9 weighs about 1.4 kilograms, giving a resistance to weight ratio of better than 10:1.

In a rudimentary form of the device, the casing 27 may include an opening via which a user can access the selector plate 53 to vary their selection although it is preferred that a separate user-manipulable portion be provided that enables the user to make selections from outside the casing 27 whilst the selector plate 53 and similar inner workings remain hidden away.

Figure 17:
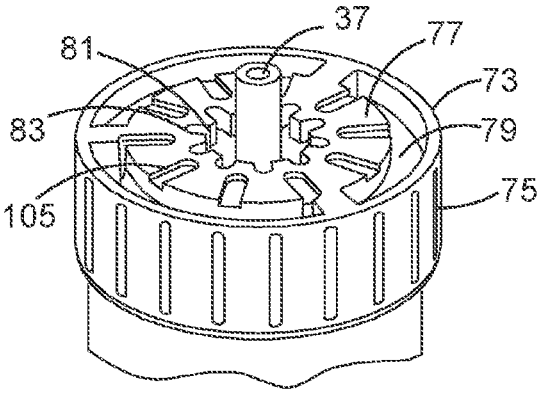
FIGS. 17 and 18 are perspective views of selected components of the resistance device of FIG. 7.
Figure 18:
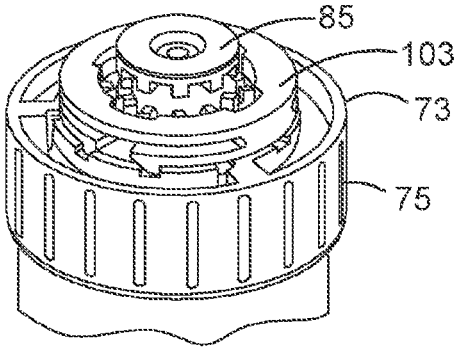

The device 9 incorporates a user-manipulable portion in the form of a selector ring 73 overlying a top end of the top tube 33. As best shown in FIG. 17, the selector ring 73 has a cylindrical exterior 75, which is suitably textured for gripping, and an internal portion 77 overlying the moveable portion 51, etc.

The overlying portion includes circumferential slots 79 through which the top cap 35 connects to the top tube 33 to complete the rigid casing 27 whilst the ring 73 is user rotatable relative to that rigid casing. The overlying portion 77 has a central opening 81 surrounded by keyways 83.

The selector plate 53 in use moves away from the selector ring 73. In a rudimentary form of the disclosed resistance device, the plate 53 and ring 73 may have complementary engagement features by which the plate 53 can be rotated, via the ring 73, when plate 53 is at the top of its stroke. Whilst such an arrangement would be workable, when the plate has moved away from the ring 73 a user could rotate the ring 73 such that the engagement features were no longer in alignment to re-engage when the plate 53 returns. This could result in the user believing that the selector mechanism has failed.

To prevent such apparent failure of the selector mechanism, the illustrated selector mechanism incorporates a separate lock member 85 by which the plate 53 and the ring 73 are mutually connected when the plate 53 is at the top of its stroke. The lock member 85 includes an internal bore via which it is mounted to slide a short distance along the guide 37. A compression spring 87 (FIG. 14) acts between the lock member 85 and the retainer plate 41 to downwardly bias the lock member 85. The spring 87 is selected to be relatively weaker than each of the gas struts whereby the gas struts overcome the spring 87 to upwardly drive the member 85 against the plate 41 when the portion 51 reaches the top of its stroke. For this purpose, the member 85 includes a face 89 adapted to bear against the top face of the plate 53. Of course, other forms of abutment for bearing against are possible.

The member 85 includes keys 91 complementary to the keyways 83 of the ring 73 whereby the ring 73 is rotationally fixed to the member 85. Other forms of complementary engagement features are possible.

A lower end of the lock member 85 incorporates keys 93 complementary to the keyways 63*a* of the selector plate. The keys 93 are arranged to engage the keyways 63*a* upon the return of the plate 53 to the top of its stroke so that the plate 53 is rotationally fixed to lock member 85. Again, other forms of engagement features are possible.

Preferably one or both of the features 93, 63*a* incorporate lead-in features to assist with re-engagement upon the return of the plate 53 to the top of its stroke. In this example the keys 93 have chamfered edges to assist with the re-engagement.

When the plate 53 is at the top of its stroke (as in FIG. 14), the ring 73, member 85 and plate 53 are rotationally locked relative to each other whereby rotating the ring 73 rotates the plate 53 between the angular positions corresponding to the dimples 69.

Figure 19:
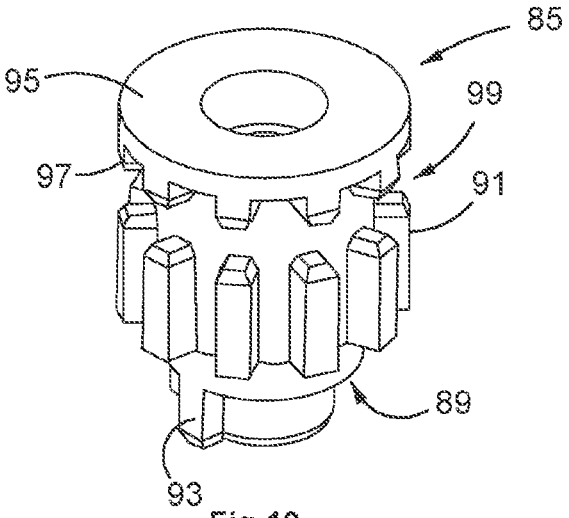
FIG. 19 is a top perspective view of a lock member of the device of FIG. 7.
Figure 20:
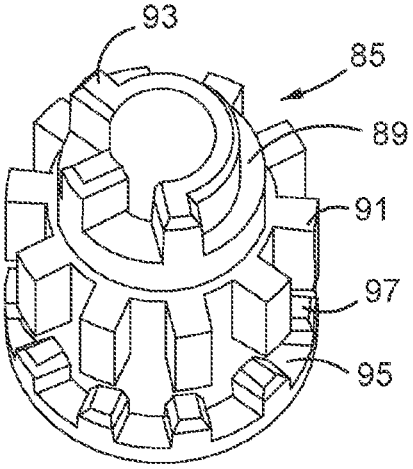
FIG. 20 is a bottom perspective view of the lock member.
Figure 21:
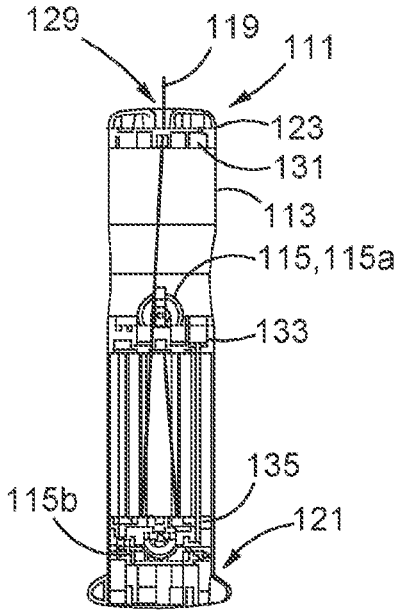
FIG. 21 is a vertical cross-section view showing selected components of a resistance device.
Figure 22:
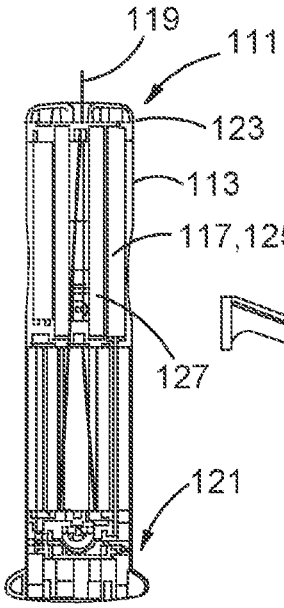
FIG. 22 is a vertical cross-section view showing selected components of the resistance device of FIG. 21.
Figure 23:
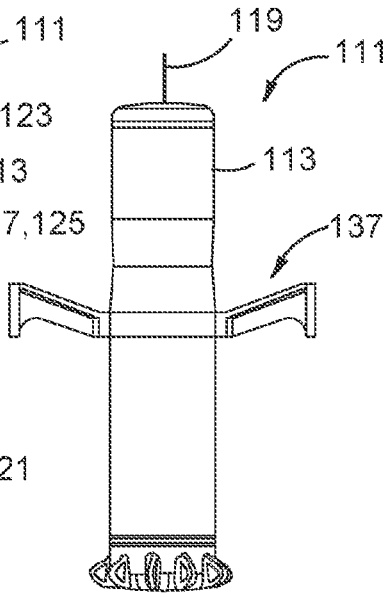
FIG. 23 is a side view of the device of FIG. 21.
Figure 24:
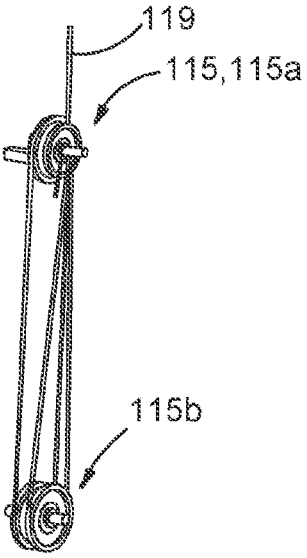
FIG. 24 is a perspective view of a transmission.

A top of the member 85 includes an overlying portion in the form of an annular flange from which keys 97 downwardly project. The keys 97 are vertically separated from the keys 91 by vertical separation 99 (FIG. 19).

Figure 14:
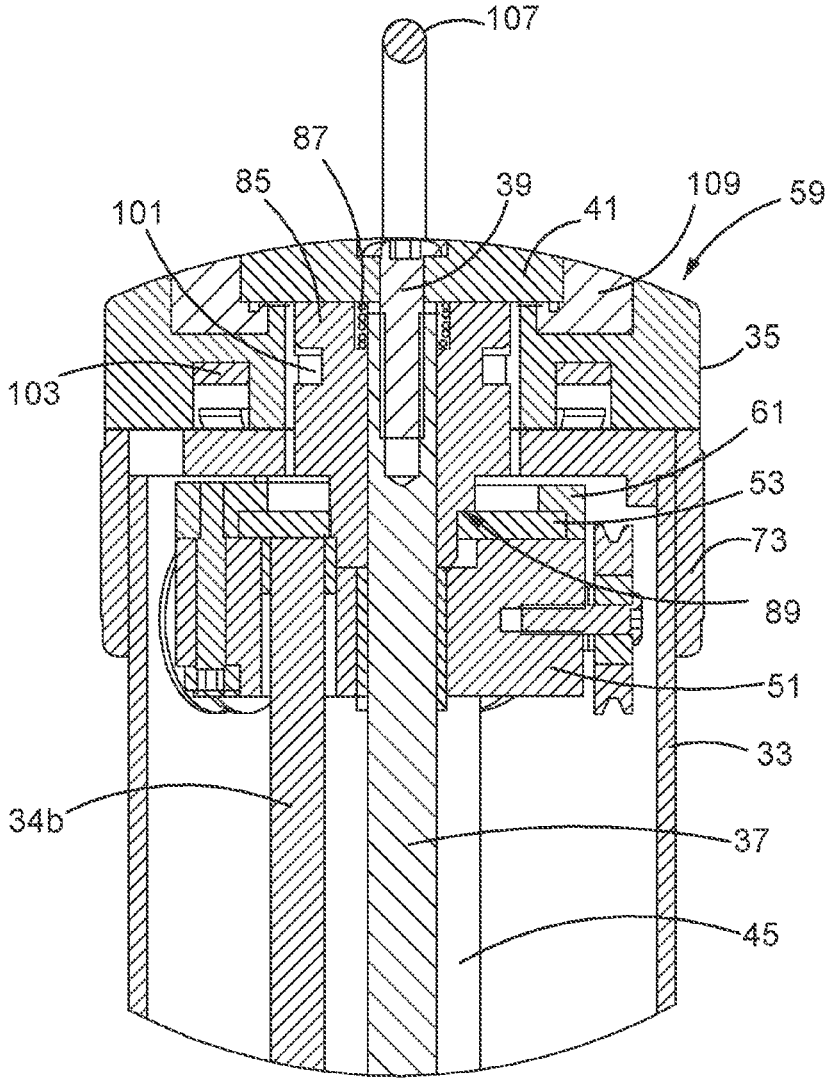
FIG. 14 is an enlargement of detail A in FIG. 11.
Figure 15:
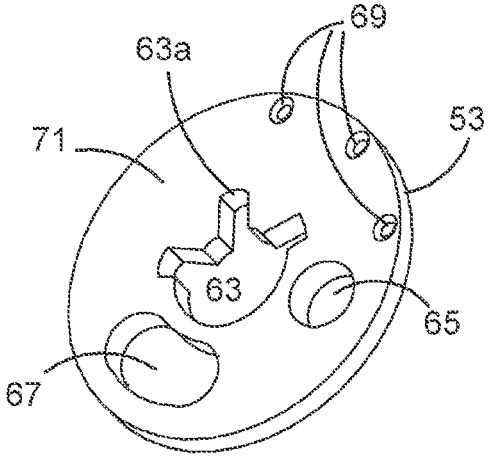
FIG. 15 is a perspective view of a selector plate.

The top cap 35 includes an array of inwardly directed fingers 101 (FIG. 14) defining a plurality of keyways complementary to the keyways 97. In the configuration of FIG. 14, the fingers 101 sit within the vertical separation 99 whereby the member 85 and members engaged therewith are permitted to rotate.

When the cable 11 is withdrawn to downwardly move the plate 53, the member 85 downwardly follows (under the influence of spring 87) bringing the keys 97 into engagement with the keyways defined by the fingers 101. This engagement rotationally locks the member 85 relative to the fixed top cap 35. Again, engagement features other than keys and keyways are possible and lead-in features to assist with this engagement are preferred. In this example the keys 97 include chamfers by which they are led into the keyways defined by the fingers 101.

During this action, whilst the lock member 85 becomes locked to the top cap 35 (and therefore cannot rotate), the selector ring 73 remains engaged with the keys 91 whereby it too cannot rotate. With subsequent downward movement, the annular flange 95 abuts the fingers 101 to arrest the downward movement of the member 85. Other stop arrangements are possible.

Figure 13:
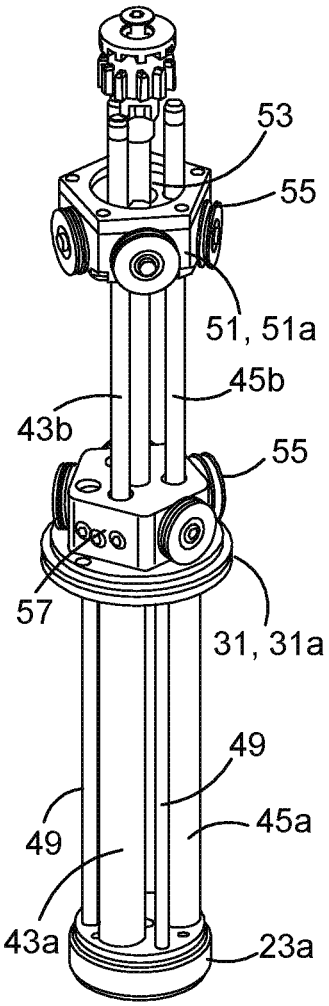
FIG. 13 is a perspective view of selected components of the device of FIG. 7.

With continued movement of the plate 53 whilst the lock member is stopped by the stop arrangement 95, 101, the plate 53 disengages the lock member 85 and continues upon its downward stroke toward the position of FIG. 13. The ring 73 remains rotationally locked relative to the fixed cap member 35 via the lock member 85. As such, a user cannot turn the ring 73 at this point.

When a user subsequently allows the cable 11 to be retracted into the body 30 under the action of the gas strut 43, the selector plate 53 rises to re-engage the member 85 and upwardly drive it back to the position illustrated in FIG. 14.

Advantageously, at no stage throughout the cyclical operation of the device 9 can the user rotate the ring member 73 without also turning the plate 53.

The detent carried by the member 51 and including the dimples 69 guards against inadvertent rotation (e.g. due to vibration) whilst the plate 53 is disengaged from the lock member 85. Whilst a friction fit could be employed to similar effect, a detent mechanism is preferred in that it provides a better feel to end users.

As a further means to provide a better feel to users, a plastic spring member 103 (FIGS. 14 and 18) acts between the top cap 135 and the ring 73 to form another detent mechanism. For this purpose a top of the overlying portion 77 includes spring clip receiving radial grooves 105. Other forms of detent mechanism between the ring 73 and the rigid casing 27 are possible.

A top end of the body 13 incorporates a mounting feature 107 by which the body 13 is mountable to a suitable anchor point, such as the anchor point of the device 1. In this example, the mounting feature 107 takes the form of a loop. The loop is carried by a swivel ring 109 (FIG. 14) carried within an upwardly open groove defined by the top cap 35. The swivel ring 109 is partly overlaid, and thereby retained, by the retaining member 41.

Many variants of the described technology are possible. By way of example, the selector plate 53 may be replaced by another suitable selector member. Likewise, the selector ring 73 may be replaced by another suitable member such as a thumb slide. An electrically actuated selector mechanism and magnetic-style adjustment are also possibilities, e.g. a suitable actuator may be added to the mechanism 59. Electrical actuation would enable actuation from a control remote from the body 13, e.g. a control built into a handle could enable the resistance to a chest press to be varied without removing the device 1 or even releasing the handle.

Figure 35:
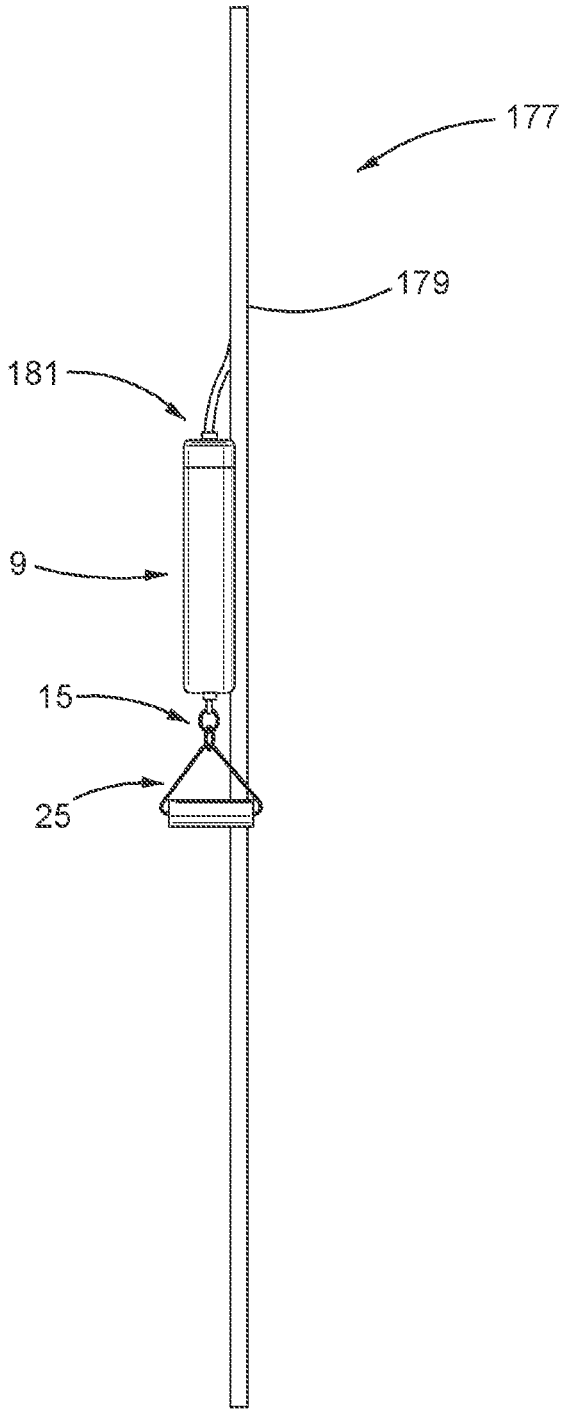
FIG. 35 is a front view of a cable machine.

FIG. 35 illustrates a cable machine 177 incorporating a variant of the resistance device 9. The machine includes a vertical rail 179. In this example the rail is wall-mounted. To suit stud walls, the rail 179 might be mounted with the aid of a bracket, e.g. horizontal rail, for spreading the load between studs. The device 9 is connected to the rail 179 at selected vertical locations via connecting arrangement 181. In a preferred variant of the machine 177, the connection arrangement 181 is configured to slide along the rail 179 and incorporates a spring-loaded detent cooperable with detent-receiving features (e.g. holes) along the rail 179.

The loop 15 of the device 9 carries a handle 25 whereby the machine 177 is configured for a variety of exercises. By way of example, the connection arrangement 181 may be dropped towards the bottom of the rail 179 to configure the machine for bicep curls, used at the illustrated shoulder height for chest presses or raised higher for pull-down exercises.

In another variant of the machine 177, the rail 179 may be replaced by a set of anchor points, e.g. wall-mounted ring-bolts, arranged to be at differing heights. To suit such variants, the device 9 may have an anchor engaging feature such as a snap hook by which the device 9 is conveniently engageable with a selected one of the anchor points.

The device 9 may also be used with an anchor point fixed to a floor or with 'a footboard'. A footboard is a portable body of material, e.g. sheet material such as plywood, upon which a user may stand and equipped with anchor points such as hooks, eyehooks or ringbolts with which the device 9 is cooperable to enable the user to perform exercises such as bicep curls.

Preferred forms of the device 9 may be attached to any convenient anchor point, e.g. to existing racks/frames or other stable stationary object such as a tree.

The resistance device 9 may be usefully applied in contexts other than exercising. By way of example, in a manufacturing environment the mounting point 107 may be anchored to an anchor point above a workbench whilst a heavy power tool is suspended from the cable 11 whereby the device 9 resists the weight of the power tool to ease the production worker's burden. Variants of the wearable device 1 may be used to assist workers to handle loads. By way of example, the device 1 in the chest press configuration of FIG. 3 could assist a worker tasked with pulling a load towards themself. The device 9 may be used to support a portion of a user's weight, e.g. to assist a worker tasked with repetitively climbing a ladder.

Reduction arrangements other than the described pulley system are possible. By way of example, the cable may be wrapped around a large spool fixed relative to a small pinion gear co-operable with a suitable rack.

The described selector arrangement has application to cableless resistance devices. A suitable output rod could be connected to the portion 51 to create a gas strut-like device capable of delivering three distinct resistances to load.

Likewise, the selector arrangement can be usefully applied in the context of resistance elements other than gas struts and variants of the selector mechanisms are suited to resistance devices having a number of resistance elements other than three resistance elements.

The described device 9 incorporates three mutually identical struts 43, 45, 47 and a selector mechanism that enables three distinct resistances to be selected. It is also contemplated that the gas struts may be mutually different, in which case the selector arrangement may be configured to select various permutations. By way of example, gas struts configured to individually present a user with 2.5 kilograms, 5 kilograms and 7.5 kilograms respectively may be individually selectable to give the user six selectable resistance options corresponding to 2.5 kilograms, 5 kilograms, 7.5 kilograms, 10 kilograms, 12.5 kilograms and 15 kilograms.

Whilst variants of the disclosed devices may be used for purposes other than exercising, the described device may be used to achieve benefits related to back strength, core strength, upper and lower body strength, aerobic cardiovascular benefits, anaerobic cardiovascular benefits, postural improvements, muscular development (hypertrophy), endurance benefits, etc. The described device can be used for high performance sport, general fitness and strength, rehabilitation, posture correction, sports specific training, coaches and trainers for use with their clients, older adult exercise, injury rehab, in a group exercise class scenario and more, etc. Variants of the described device may be employed to assist special needs persons (e.g. the wheelchair-bound, amputees and those otherwise disabled).

The described device can be securely and comfortably attached to the body so as to be safer for the spine, joint systems and core than typical gym equipment, and to promote immediate and passive core engagement.

Beyond the described wearable device 1, variants of the device 9 could be applied to commercial gym-style equipment to create a piece of gym machinery that is lighter and more portable than typical commercial machines.

FIGS. 21 to 34 detail a large resistance device suited to gym-style equipment and more powerful exercises (or more powerful other applications).

The device 111 incorporates a housing 113 housing a transmission 115 and a resilient arrangement 117. The housing 113 is elongate, i.e. is more than three times longer than it is wide and in this particular example is approximately cylindrical. A cable 119 emerges from a first end of the housing 113. A selector mechanism 121 is located at the second end of the housing 113.

The resilient arrangement 117 includes two sets 125, 127 of four gas struts.

The first end of the housing 113 is capped by an end piece 123. The end piece 123 defines an outlet bell mouth 129 for the cable 119. The end piece 123 further defines inwardly directed sockets 131 for receiving the ends of the bodies of the gas struts.

Along the length of the housing 113 an interior of the housing 113 is spanned by a fixed piece 133 fixed relatively to the housing 113. The piece 133 defines stepped bores each of which includes an upwardly open socket portion, for receiving the end of a respective strut body, and a narrower exit portion through which the rod of the respective gas strut passes. The piece 133 carries two pulleys 115*a* of the transmission 115.

In other variants the housing 113 might be replaced by other suitable support structure interconnecting the relevant components mentioned below.

The piece 133 forms part of the resilient arrangement 117. Another part of the resilient arrangement 117 is the moving unit 135 towards the second end of the housing 113. The moving unit 135 forms part of the selector mechanism 121 and selectively co-operates with the gas struts 125, 127. It also carries pulleys 115*b* of the transmission 115.

Figure 25:
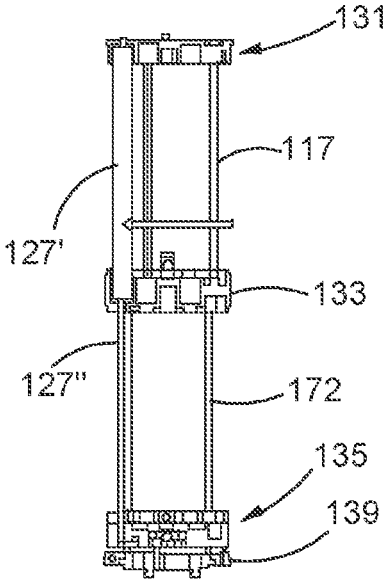
FIG. 25 is a vertical cross-section view of selected components of the device of FIG. 21.

As best shown in FIG. 25 the pieces 131, 133 are tied to each other by tie rods 171 that but are held in tension to clamp the strut bodies 127' in place whilst the strut rods 127" project downwardly through the member 133. Guide rods 172 extend downwardly from the member 133. The movable unit 135 runs along the guide rods 172. The guide rods are preferably polished. Other forms of guide are possible. The moving unit 135 is fitted with Teflon™ sleeves to slide smoothly over the rods 172 even under the influence of asymmetric forces from the gas struts 125, 127.

In this example there are two pulleys 115*b* and those pulleys are coaxial to each other. The cable 119 is laced about the pulleys 115*a*, 115*b* to form the transmission connecting the cable 119 to the resilient arrangement 117. In this example the cable 119 is laced about each of the pulleys 115 and one of the pulleys 115*a*, and anchored relative to the housing 113 (or more specifically relative to the piece 133) whereby the transmission 115 has a reduction ratio of 4:1. As a result of this reduction ratio, withdrawing a length of cable 119 from the device 111 moves the moving unit 135 towards the fixed piece 113 (and thus compresses the gas struts 125, 127) only a proportion of that length. In this case, the proportion is 0.25.

The device 111 incorporates mounting features 137 by which the device 111 is mountable to suitable structural elements of gym-style equipment. In this case the mounting features 137 take the form of wings which may be integrally formed with the piece 133.

Figure 30:
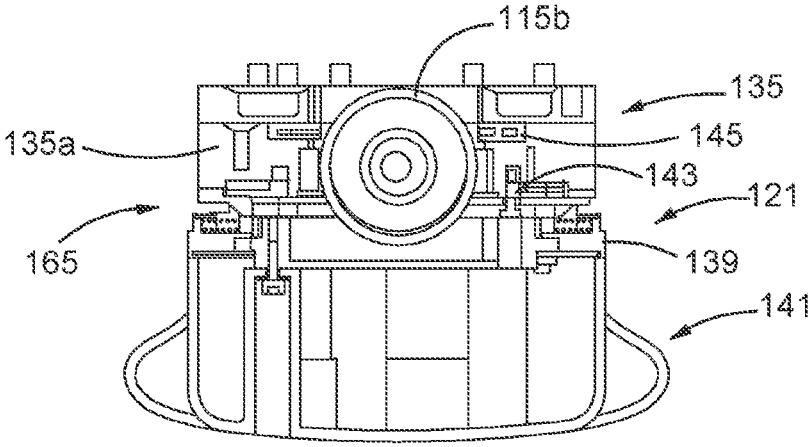
FIG. 30 is a vertical cross-section view of a selector mechanism.
Figure 31:
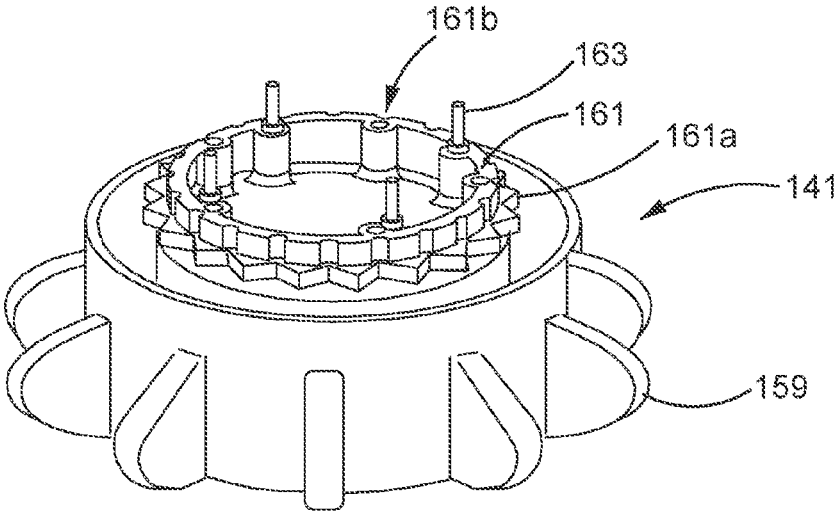
FIG. 31 is a perspective view of a handle.
Figure 32:
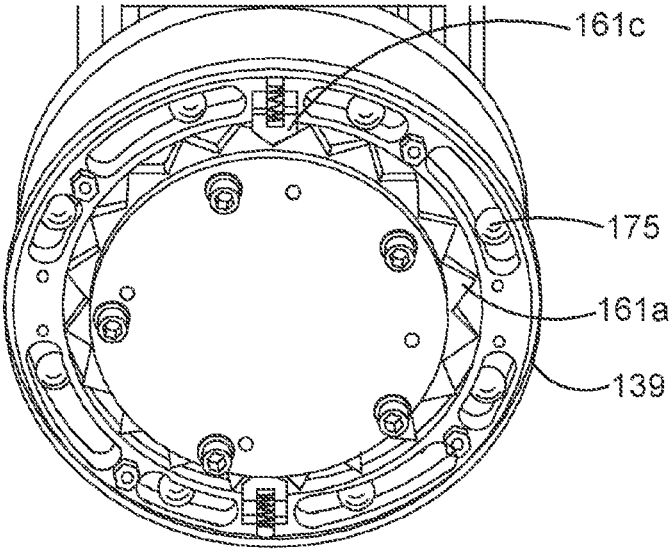
FIG. 32 is a bottom perspective view of selected components of a selector mechanism.
Figure 33:
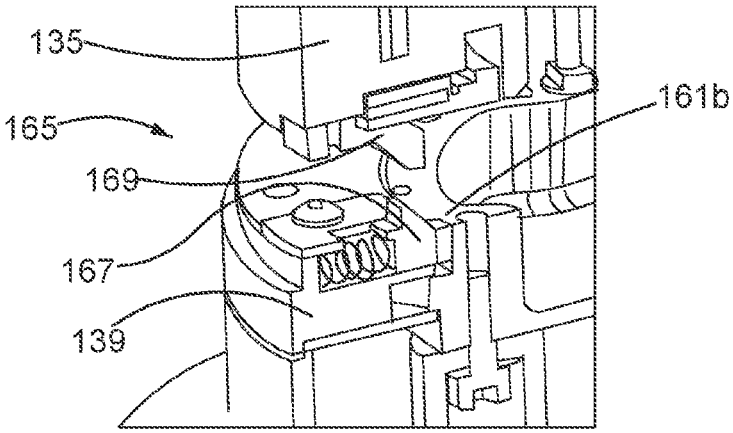
FIG. 33 is a perspective vertical cross-section view of a locking mechanism in a locked configuration.
Figure 34:
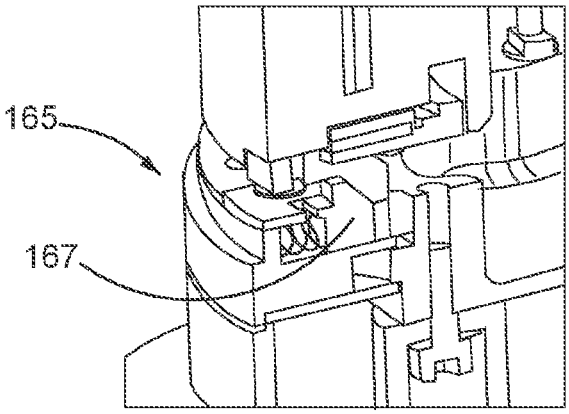
FIG. 34 is a perspective vertical cross-section view of the locking mechanism of FIG. 33 in an unlocked configuration.

As best shown in FIG. 30 the selector mechanism 121 incorporates three principal components: the movable unit 135, a fixed ring 139 and a handle unit 141.

The movable unit 135 is punctuated by passages for accommodating non-selected ones of the gas struts 125, 127 whereby in use of the device the movable unit 135 moves along the non-selected gas struts without compressing those struts.

The movable unit 135 further includes an outer selector ring 143 and an inner selector ring 145. The rings 143, 145 serve to selectively block the strut-accommodating passages to engage selected ones of the struts. The movable unit 135 further includes an irrotational body member 135*a* mounted to move along the housing 113. The rings 143, 145 are carried by the body member 135*a*.

The movable unit 135 includes a detent mechanism 147 best shown in FIG. 29. The mechanism 147 incorporates 20 grooves 147*a* equispaced about the ring 143 and a spring-loaded member 147*b* engageable with the grooves 147*a*.

Returning to FIG. 26, the outer selector ring 143 incorporates five outwardly projecting strut-engaging portions 143*a* equispaced about its perimeter and defining five strut-accommodating regions 143*b*.

The outer selector ring 143 is configured to co-operate with the first set 125 of struts 125*a* to 125*d*. The struts 125*a*, 125*b*, 125*c*, 125*d* are configured to provide about 5 kilograms, 10 kilograms, 15 kilograms and 20 kilograms of resistance respectively.

Figure 26:
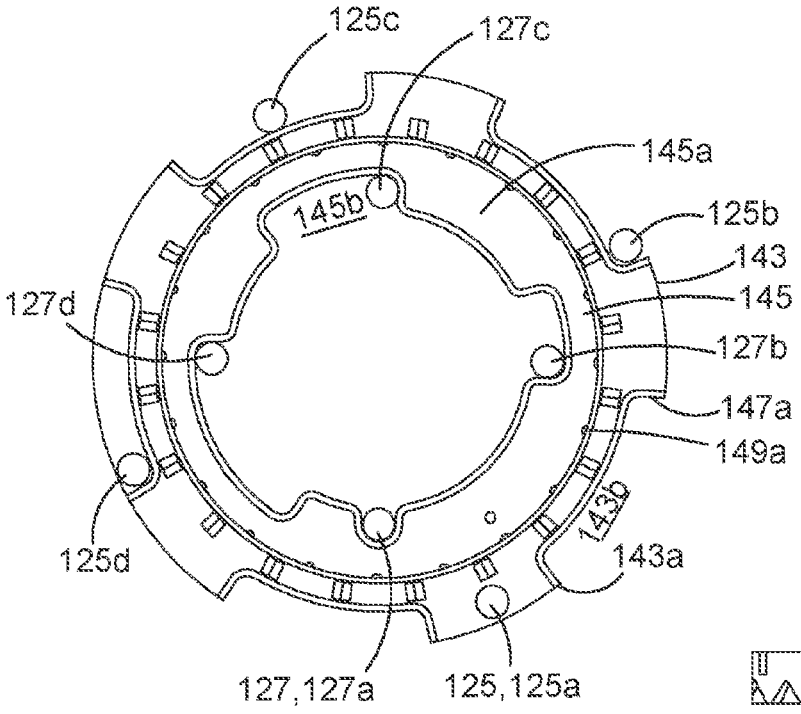
FIG. 26 is a plan view of selector rings of the device of FIG. 21.

The outer ring 143 engages only a selected one of the struts 125 at any one time. In the configuration of FIG. 26 the ring is set to engage only the 5 kilogram strut 125*a*. Rotating the ring 143 one increment (of the 20 rotational increments) anti-clockwise (as drawn) positions the engaging portion 143*a* to clear the 5 kilogram strut 125*a*. That strut is thereby selected. The same movement moves another of the engaging portions 143*a* into register with the 10 kilogram strut 125*b* whereby that strut is selected. The 15 kilogram and 20 kilogram struts 125*c*, 125*d* remain in register with respective strut-accommodating portions 143*b* and as such remain de-selected. Accordingly through this single incremental movement of the ring 143 the resistance associated with that ring is incremented. In this example, the increment is 5 kilograms. A common increment (5 kilograms in this case) is preferred although it is possible that the increment might vary from movement to movement, e.g. the struts 125 might be configured to provide a sequence of forces corresponding to 2.5, 5, 10 and 20 kilograms instead of 5, 10, 15 and 20 kilograms. Both potential configurations provide monotonically increasing sequences. Monotonic sequences are preferred.

In the illustrated example rotating the ring 143 provides a sequence (5, 10, 15, 20) of resistances associated with the ring. Further incremental movement of the ring causes that sequence to repeat, i.e. so that after the 20 kilogram strut 125*d* has been selected anti-clockwise rotation of the outer ring 143 will provide the user with 5 kilograms of resistance associated with the outer ring.

The inner ring 145*a* co-operates with the second set of gas struts 127 each of which is configured to provide a resistance of about 20 kilograms.

The ring 145 has four inwardly directed strut-engaging portions 145*a* defining four strut-accommodating regions 145*b*. Whereas the ring 143 engages only a selected one of the struts 125 at any one time, the ring 145 engages a selected number of the struts 127 to vary the resistance associated with the ring 145.

Figure 29A:
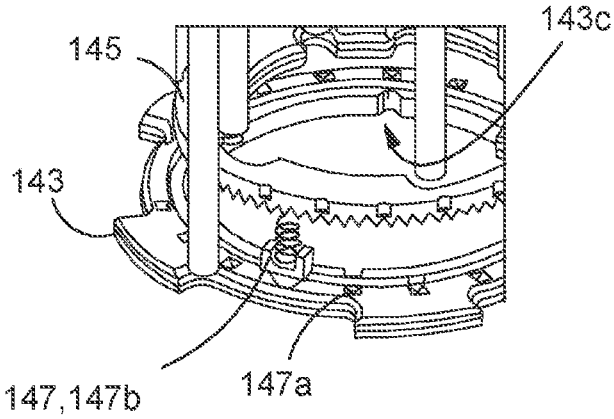
FIG. 29*a* is a perspective view of a detent mechanism.
Figure 29B:
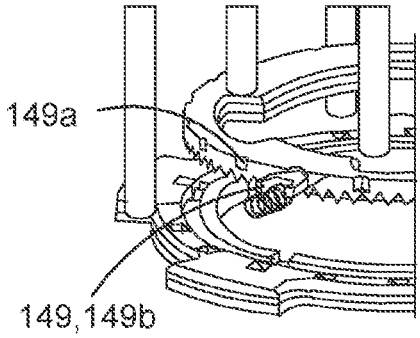
FIG. 29*b* is a perspective view of another detent mechanism.

A detent mechanism 149 best shown in FIG. 29*b* serves to define 20 angular positions of the ring 145. The mechanism 149 includes a spring-loaded detent member 149*b* that moves radially (relative to the ring 145) to co-operate with 20 detent-recesses 149*a* equispaced about the periphery of the ring 145. In the angular position of FIG. 26 each of the struts 127 sits in register with a respective one of the strut-accommodating regions 145*b* whereby the ring 145 provides no resistance to the user.

Rotating the ring 145 one increment in a clockwise direction from the position of FIG. 26 positions a blocking portion 145*a* to engage the strut 127*a* whereby 20 kilograms of force associated with the inner ring 145 is provided to the user. A further clockwise incremental movement brings blocking portion 145*a* into position to engage the strut 127*b* to select the struts 127*b* (whilst strut 127*a* remains selected) and provide the user with 40 kilograms of resistance associated with the inner ring 145. Two further incremental clockwise movements of the ring 145 leads to all four struts 127 being selected.

An intermittent motion mechanism 151 interconnects and co-ordinates the rings 143, 145. Movement of the ring 143 drives the ring 145 via the mechanism 151.

The mechanism 151 incorporates a pinion gear 153 and a pair of racks 155, 157. The pinion gear 153 is pivotally carried by the body 135*a*.

The rack 157 is a downwardly directed annular rack comprising a substantially continuous ring of teeth co-operable with the pinion gear 153. In contrast the rack 155 is a discontinuous rack made up of five pairs 155*b* of upwardly directed teeth equispaced about the ring 143. The rack 155 further includes flat portions 155*a* separating the pairs 155*b*.

The mechanism 151 is configured so that during the 5, 10, 15, 20 kilogram sequence of the ring 143 the pinion gear 153 remains stationary whilst it relatively moves along one of the flats 155*a*. At the end of the 5, 10, 15, 20 kilogram sequence, a pair 155*b* of teeth engages the pinion gear to cause it to rotate and in turn cause the inner ring 145 to rotate through one increment in the opposite direction to the rotation of the outer ring 143. Accordingly after the user is presented with a total resistance of 20 kilograms a further incremental movement of the outer ring 143 presents the user with 25 kilograms of resistance corresponding to 5 kilograms from the outer ring and 20 kilograms from the inner ring. A further three incremental movements of the outer ring leads to only struts 125*d*, 127*a* being selected to provide a user with 40 kilograms of resistance. From this position a further incremental movement of the outer ring 143 leads to only struts 125*a*, 127*a*, 127*b* being selected to provide the user with 45 kilograms of resistance.

Figure 28:
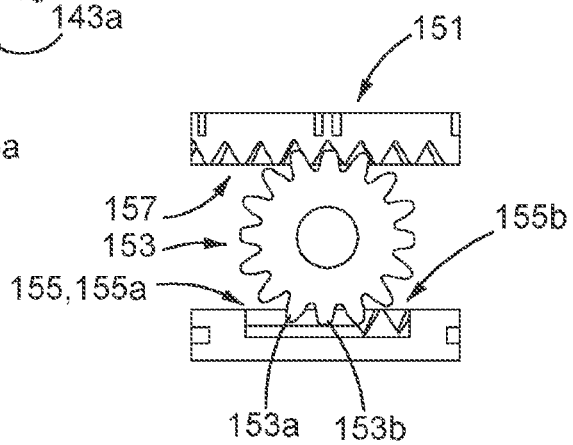
FIG. 28 is a cross-section view showing the pinion gear of the intermittent motion mechanism of FIG. 27.
Figure 27:
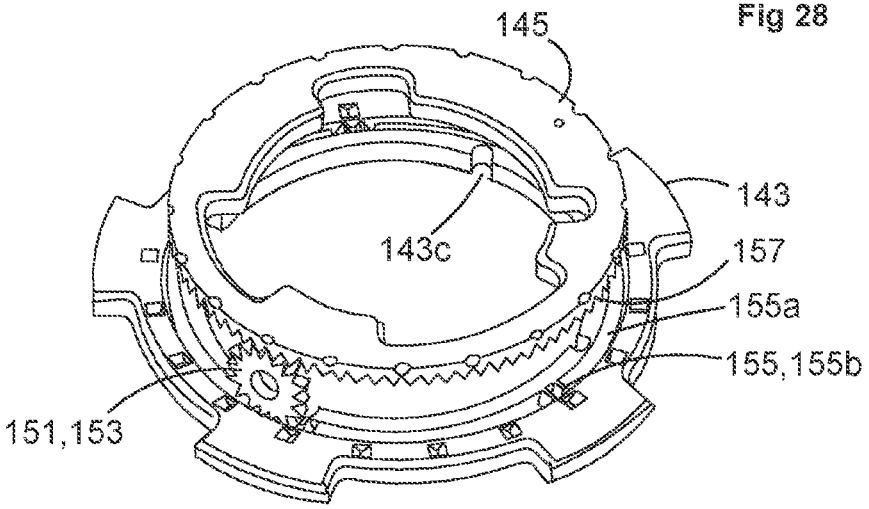
FIG. 27 is a perspective view of the selector rings of FIG. 26 and an intermittent motion mechanism thereby.

The flats 155*a* are blocking portions for positively blocking the pinion gear 153 against movement until the pairs 155*b* of teeth are brought into contact with the gear 153. For this purpose, the pinion gear 153 is a modified pinion gear having truncated teeth. In this example, the gear 153 has 16 teeth and every fourth one of those teeth is truncated. As illustrated in FIG. 28 whilst the sequence of the ring 143 is underway the truncated tooth 153*b* and the two adjacent teeth 153*a* sit in close proximity to the flat 155*a*. In this position, the flat 155*a* blocks the adjacent teeth 153*a* to prevent the pinion 153 rotating in either direction.

In this example, the length of the truncated teeth 153*b* is a compromise between being long enough to engage the rack 157 and short enough to avoid jamming against the blocking portion 155*a*. In an alternative pinion arrangement the racks 157, 155 are set at different radii and the pinion member 153 has a complex shape and a thickness related to the difference in radii. This complex pinion may have:

- a conventional tooth portion to co-operate with the rack 157; and
- a gear portion in which the truncated teeth 153*b* and the two adjacent teeth 153*a* are replaced by a solid flat for more positively engaging the blocking portion 155*a*.

Other forms of intermittent motion mechanism 151 are possible, e.g. the mechanism 151 might be replaced by a Geneva drive or an arrangement of cams. Mechanical intermittent motion mechanisms are preferred.

Preferably the rings 143, 145 are formed of polymer over moulded on metal, e.g. on steel. This construction cost-efficiently provides a component with the strength of a metallic support and the complex shapes of the racks and detent features etc. The polymer may be polyamide nylon. The support may be stainless steel.

The fixed ring 139 (FIG. 30) is mounted at an end of an outer tube of the body 113. Other forms of fixed portion are possible. The handle 141 is pivotally carrier by the ring 139.

The handle portion 141 includes a moulded handle 159, a locking wheel 161 and four drive pins 163 upwardly extending from the wheel 161. Conveniently the handle 159 is moulded from plastic with a suitable form to be conveniently gripped and rotated. In this example the handle portion 159 has radial fins defining finger receiving spaces. Preferably one of the outer tube of the housing 113 and the handle 159 carries a series of indicia corresponding to the available resistances whilst the other of those two things carries a suitable pointer whereby the user is provided with a visual indication of the selected resistance.

The locking wheel 161 has a complex exterior including triangular teeth 161*a* and outwardly directed recesses 161*b*. The teeth 161*a* form part of a detent mechanism including spring-loaded detent members 161*c* to provide a user with desirable tactical qualities as the handle 159 is clicked from one position to another.

The upwardly directed pins 163 engage drive slots 143*c* (FIGS. 27 and 29*a*) equispaced about an interior of the ring 143. Other drive arrangements are possible. When the gas struts are extended and the movable unit 135 is at the end of its stroke, the pins 163 are engaged with the movable unit 135 (or more specifically with the cut-outs 143*c* in this example) whereby the outer ring 143 rotates with the handle 159 allowing a user to adjust the resistance. When a user pulls on the cable 119 to move the movable unit 135 away from the end of the housing 113, the unit moves away from and so disengages the pins 163.

The detents 147, 159 and blocking portion 155*a* serve to prevent the rings 143, 145 rotating during this mid-stroke phase of the device's operation; that is, whilst the unit 135 is disengaged from the pins 163). A locking arrangement 165 (FIGS. 30, 33 and 34) locks the handle 141 against rotation during this mid-stroke phase of operation so that the drive pins 163 remain in position to engage the movable unit 135 upon its return at the end of the housing.

The locking arrangement 165 includes a spring-loaded latch member 167 carried by the fixed portion 139 and biased towards engaging the recesses 161*b*. The lock 165 further includes a striker 169 carried by the movable unit 135 and arranged to strike the member 167 upon the unit's return to the end of the housing. The member 167 and striker 169 have complementary forms configured so that as the striker 169 moves axially (driven by the gas struts 125, 127) into engagement with the member 167, the member 167 is driven to disengage the groove 161*b* (that is to move the member 167 from the position illustrated in FIG. 33 to the position illustrated in FIG. 34 in this case).

To ensure that the movable unit 135 is fully homed to unlock the locking arrangement 165 and permit adjustment of the resistance, the fixed portion 139 carries magnets 175 which magnetically co-operate with the body 135*a* when that body moves into proximity with the magnets. Other homing arrangements are possible; e.g. another option is to provide a gas strut that remains permanently engaged with the movable unit 135 and to positively drive that unit to its home position.

Preferred variants of the device 100 are not more than about 1 metre long, and weigh not more than about 15 kilograms yet provide up to 100 kilograms of resistance. The illustrated example provides 5 kilograms to 100 kilograms of resistance adjustable at 5 kilogram increments therebetween.

Advantageously the device 111 can be incorporated into a wide variety of exercise equipment in place of weight stacks, e.g. in the context of a lat-pull down machine the device can be mounted with the handle 159 within reach of the user whilst the other end of the device presents the cable for convenient routing about pulleys on route to a suitable long handle. Particularly in the context of gym-style equipment wherein the device is not routinely turned over, it is preferred to have the gas struts oriented so that the rods extend downwardly from the strut bodies. This keeps the seals within the strut bodies lubricated.

Some variants of the device may incorporate resilient elements other than gas struts, although gas struts are preferred. In particular gas struts having a cylinder OD to rod OD ratio above 3 (e.g. 28:8) are preferred to provide reduced force-variation over the stroke of the gas strut.

Like the device 9, the device 111 lends itself to automation, data logging and inclusion in the internet of things. The selector mechanism may be servo-actuated. Potentially the device may include a battery or other energy store. The device may further include an internal dynamo by which the store is charged from the movement associated with the use of the device. This conveniently enables an electronic version of the device to operate without the cost and unsightly appearance of a power cord. The device may include a suitable sensor such as an accelerometer as part of a rep counting mechanism. Advantageously the device is configured to wirelessly communicate (e.g. communicate via Bluetooth™) with external devices, e.g. with a controller for controlling the device 111 and/or with a display for displaying data from the device 111. A personal electronic device such as an iPhone™ may conveniently operate as both a controller and a display. Electronic programs, e.g. an app on the iPhone™, may be used to variably control the device to provide a defined workout and/or to log and display the results. The program may be stored as instructions on a computer readable medium.

What is claimed is:

1. A resistance device, for providing a resistance, the resistance device comprising:

a flexible pulling element;

a resilient arrangement; and a transmission;

the resilient arrangement having a first portion and a second portion, the second portion being resiliently movable relative to the first portion;

the transmission connecting the flexible pulling element to the resilient arrangement such that pulling upon the flexible pulling element moves the second portion relative to the first portion, and upon release of the flexible pulling element the resilient arrangement retracts the flexible pulling element, and the transmission being a reduction arrangement such that pulling the flexible pulling element a distance moves the second portion, relative to the first portion, no more than a proportion of the distance, the proportion being no more than half;

the resilient arrangement including a plurality of resilient elements, at least one of the resilient elements being a selectable element;

the resistance device including a selector mechanism by which at least one of the at least one selectable element is selectively engageable to vary the resistance;

the selector mechanism including a selector member carried by the second portion, the selector member being movable:

to engage the selectable element(s) such that the selector member abuts each of the at least one selectable element to resist movement of the flexible pulling element, and to disengage the or each selectable element so as to enable the second portion to move along each of the at least one selectable element.

2. The resistance device of claim 1, wherein the proportion is no more than one ninth.

3. The resistance device of claim 2, wherein the transmission includes an arrangement of pulleys.

4. The resistance device of claim 1 including a feature by which the resilient arrangement is connectable, the feature being at least one of a loop and a hook.

5. The resistance device of claim 1, wherein the flexible pulling element has a loop to which a handle is attachable.

6. The resistance device of claim 1, wherein the flexible pulling element has a handle.

7. The resistance device of claim 1, wherein the flexible pulling element has an ankle strap.

8. The resistance device of claim 1, wherein the resilient arrangement has a stroke length of not more than 150 mm.

9. The resistance device of claim 1, wherein the resilient arrangement includes one or more gas struts or compression spring.

10. The resistance device of claim 1, wherein the plurality of resilient elements is at least three resilient elements and the selector mechanism has a first configuration for engaging one of the resilient elements;

a second configuration for engaging two of the resilient elements; and a third configuration for engaging three of the resilient elements.

11. The resistance device of claim 1 including a user-manipulated portion manipulated by a user to move the selector member, the selector member being arranged to move away from the user-manipulated portion when the second portion moves relative to the first portion.

12. The resistance device of claim 11, including a detent-mechanism acting between the user-manipulated portion and a fixed portion of the device to cause the user-manipulated portion to click into positions corresponding to a disengaging position and engaging position.

13. The resistance device of claim 11, including a locking mechanism for locking the user-manipulated portion against inadvertent movement when the selector member is moved away.

14. The resistance device of claim 13, wherein the locking mechanism includes a lock member movable from a locking position, in which the lock member engages both of a fixed portion of the resistance device and the user-manipulated portion, to an adjusting position in which the lock member is movable relative to the fixed portion and engages both of the user-manipulated portion and the selector member.

15. The resistance device of claim 14, including a bias-element by which the lock member is resiliently biased toward the locking position, the lock member being arranged to be driven against the bias-element and away from the locking position by the resilient arrangement.

16. The resistance device of the claim 1, wherein the second portion includes a detent-mechanism to restrain the selector member.

17. A wearable exercise device comprising:

at least one resistance device including:

a flexible pulling element, a resilient arrangement; and a transmission;

the resilient arrangement having a first portion and a second portion, the second portion being resiliently movable relative to the first portion;

the transmission connecting the flexible pulling element to the resilient arrangement such that pulling upon the flexible pulling element moves the second portion relative to the first portion, and upon release of the flexible pulling element the resilient arrangement retracts the flexible pulling element, and the transmission being a reduction arrangement such that pulling the flexible pulling element a distance moves the second portion, relative to the first portion, no more than a proportion of the distance, the proportion being no more than half;

the resilient arrangement including a plurality of resilient elements, at least one of the resilient elements being a selectable element;

the device including a selector mechanism by which at least one of the at least one selectable element is selectively engageable to vary the resistance;

the selector mechanism including a selector member carried by the second portion, the selector member being movable:

to engage the selectable element(s) such that the selector member abuts each of the at least one selectable element to resist movement of the flexible pulling element, and to disengage each of the at least one selectable element so as to enable the second portion to move along each of the at least one selectable element.

18. The wearable exercise device of claim 17, further comprising shoulder straps.

19. A method of exercising comprising:

pulling a flexible pulling element of a resistance device: wherein the resistance device comprises:

a flexible pulling element;

a resilient arrangement; and a transmission;

the resilient arrangement having a first portion and a second portion, the second portion being resiliently movable relative to the first portion;

the transmission connecting the flexible pulling element to the resilient arrangement such that pulling upon the flexible pulling element moves the second portion relative to the first portion, and upon release of the flexible pulling element the resilient arrangement retracts the flexible pulling element, and the transmission being a reduction arrangement such that pulling the flexible pulling element a distance moves the second portion, relative to the first portion, no more than a proportion of the distance, the proportion being no more than half;

the resilient arrangement including a plurality of resilient elements, at least one of the resilient elements being a selectable element;

the device including a selector mechanism by which at least one of the at least one selectable element is selectively engageable to vary the resistance;

the selector mechanism including a selector member carried by the second portion, the selector member being movable:

to engage the selectable element(s) such that the selector member abuts each of the at least one selectable element to resist movement of the flexible pulling element, and to disengage each of the at least one selectable element so as to enable the second portion to move along each of the at least one selectable element.

20. The method of claim 19, further comprising moving the selector mechanism from at least one engaging position to a disengaging position.

* * * * *